US006783471B2

(12) United States Patent
Bolduc et al.

(10) Patent No.: US 6,783,471 B2
(45) Date of Patent: Aug. 31, 2004

(54) SPORTS ACTIVITY TRAINING INSTRUMENT

(75) Inventors: Henry P. Bolduc, Mystic, CT (US); Alan Lewit, Norwich, CT (US)

(73) Assignee: LB Technologies, LLC, Mystic, CT (US)

( * ) Notice: Subject to any disclaimer, the term of this patent is extended or adjusted under 35 U.S.C. 154(b) by 0 days.

(21) Appl. No.: 10/119,467

(22) Filed: Apr. 9, 2002

(65) Prior Publication Data

US 2003/0190983 A1 Oct. 9, 2003

(51) Int. Cl.[7] ..... A63B 69/00; A63B 59/00

(52) U.S. Cl. ..... 473/457; 473/564; 473/568

(58) Field of Search ..... 473/422, 437, 473/457, 558–568, FOR 105, 169, 170, 44–51, 308, 310, 318, 296; 463/47.5–47.7, 47.1, 47.2

(56) References Cited

U.S. PATENT DOCUMENTS 537,927 A * 4/1895 Kennedy ..... 473/520
546,540 A * 9/1895 Kennedy ..... 473/520
1,334,188 A * 3/1920 Swan ..... 463/47.2
3,170,690 A * 2/1965 Goranson et al. ..... 473/295
3,173,688 A * 3/1965 Green ..... 473/568
3,236,521 A * 2/1966 Knott ..... 473/457
3,246,894 A * 4/1966 Salisbury ..... 473/457
3,476,388 A * 11/1969 Hackett ..... 473/48
3,618,945 A * 11/1971 Kuchar et al. ..... 473/457
3,679,205 A * 7/1972 Finkle et al. ..... 473/463
4,399,996 A * 8/1983 Boyce ..... 473/457
4,555,111 A * 11/1985 Alvarez ..... 473/457
4,763,899 A * 8/1988 Hundley ..... 473/256
4,856,782 A * 8/1989 Cannan ..... 473/232
5,000,153 A * 3/1991 Zimmerman et al. ..... 124/5
5,131,651 A * 7/1992 You ..... 473/520
5,236,198 A * 8/1993 Haines et al. ..... 473/521
5,277,427 A * 1/1994 Bryan et al. ..... 473/232
5,516,097 A * 5/1996 Huddleston ..... 473/457
5,599,021 A * 2/1997 Lary et al. ..... 473/219
5,728,008 A * 3/1998 Howard ..... 473/308
6,241,629 B1 * 6/2001 Otto ..... 473/457
6,398,652 B1 * 6/2002 Schweizer et al. ..... 463/47.5
6,569,042 B2 * 5/2003 LaChance et al. ..... 473/457

* cited by examiner

*Primary Examiner*—Steven Wong
*Assistant Examiner*—Mitra Aryanpour

(57) ABSTRACT

A training instrument for a sport in which an object is struck or thrown by a player grasping the instrument with two hands. The instrument includes a handle having a hand gripping portion and a separate head having a hand gripping portion, a bearing member and an elastomeric sleeve. The handle and head normally have a common longitudinal axis. The head has an end adjacent to the handle with an at least partially rounded ends received in contact with the bearing member which has a concave surface receiving the rounded end of the head. The sleeve extends over the gripping portions of the handle, head and bearing and maintains the handle and head in normal longitudinal alignment, but permits pivotal movement of the head with respect to the handle.

20 Claims, 4 Drawing Sheets

SPORTS ACTIVITY TRAINING INSTRUMENT

FIELD OF THE INVENTION

This invention relates to a training instrument for a sport in which a ball or similar object is struck or thrown by a player grasping the instrument with both hands such as a baseball bat, a cricket bat, a lacrosse stick known as a crosse, and a tennis racket which is sometimes swung with both hands.

BACKGROUND OF THE INVENTION

In sports activities where an instrument is held with both hands and used to strike, propel or throw an object, the instrument is held at or adjacent to one end thereof with a first hand with the second hand adjacent thereto, or in the case of a hockey stick the second hand is spaced from the first hand.

The first hand predominantly provides a pivot although it will move in an arc-like motion, while the second hand predominantly provides power and/or acceleration to the struck or thrown object. It is important that movement of the hands must be in coordination to properly impact an object at the point of contact of the instrument with the object or the point of release of the object in the case of throwing the ball in lacrosse.

In baseball (the term "baseball" includes softball as used herein), in the art of instructing batters skill drills are employed to attempt to teach a batter to develop proper top and bottom hand movement when swinging a bat. A problem with such drills is that each hand is drilled individually, which is not the case when an athlete is attempting to hit a moving object. If a batter uses a bat that is articulated or pivotal between the gripping hands, he cannot accelerate the bat head unless the top hand on the bat is effectively employed. The principal purpose of a training bat that is articulated or pivotal between the gripping hands is to teach the batter to develop proper swing mechanics, which will lead to bat head accuracy and improve eye-hand coordination.

An articulated training bat has previously been disclosed by Gary C. Boyce in U.S. Pat. No. 4,399,996. This patent discloses an articulation on a training bat between the two hand gripping portions that is designed to teach the batting student to have the second hand lead the first hand at the point and time of impact of the bat on the ball.

Generally speaking, at the point and time of impact the first hand should not be ahead of the second hand, dependent on the direction of swing, otherwise little power is imparted to the ball when struck. The second hand must be leading the first hand in the swing or snapping into a leading position at the time of impact to provide maximum bat velocity at the time ball is impacted.

The articulation of the instrument between the hand gripping portions provides a hands-on or tactile perception of the proper relative hand motion during a swing and with repeated practice either with or without a thrown ball, the batting student improves hand coordination as well as build-up of wrist and arm strength. This will ultimately result in increased bat acceleration at time of ball impact resulting in harder hit and/or longer hit balls.

The practice bat of the aforementioned patent is very labor and material intensive requiring modification of an existing bat by severing one hand portion from the end of the bat, counter boring both of the facing severed portions, screw securing both ends of a helical spring in the counter bores with screws and a potting compound and then providing bumpers at the severed ends of the bat. This construction still leaves an opening between the severed ends of the bats which could pinch a hand or fingers of a user when one portion is articulated with respect to the other.

The present invention provides a sports training instrument of the type stated which is an improvement over the bat disclosed in the aforementioned patent. The present invention provides a sports training instrument which requires only one or two additional elements if made from an existing instrument, i.e., a bat.

The invention will be predominantly described as embodied in a baseball/softball bat although it may be embodied in other sports instruments as hereinafter described.

An object of this invention is to provide a new and improved sports activity training instrument of the type in which two hands are utilized to swing the instrument to strike a moving object or to throw a captured object.

Another object of this invention is to provide a new and improved baseball/softball training bat.

A further object of this invention is to provide a new and improved sports activity training instrument in which there is no separation between the handle and head portions which could cause pinching of the hands or fingers upon use.

SUMMARY OF THE INVENTION

Briefly stated, the invention as embodied in one form thereof in a training bat for baseball/softball comprises separate handle and head portions. The handle and head normally have a common longitudinal axis. At least the head portion has an at least partially rounded end in contact with a bearing member at the adjacent handle end which permits the head portion to pivot with respect to the handle. The bearing member has a concave surface receiving the rounded end of the handle portion. An elastomeric sleeve extends over the gripping portions of the handle, head and bearing and maintains the handle and head in normal axial longitudinal alignment, but permits pivotal movement of the head with respect to the handle, and prevents a finger or hand part from being pinched between the two bat portions.

The invention is particularly pointed out and distinctly claimed in the concluding portion of this specification. The invention, however, together with further objects and advantages thereof may be best appreciated by reference to the following detailed description taken in conjunction with the drawings

DETAILED DESCRIPTION OF PREFERRED EMBODIMENTS OF THE INVENTION

Figure 1:
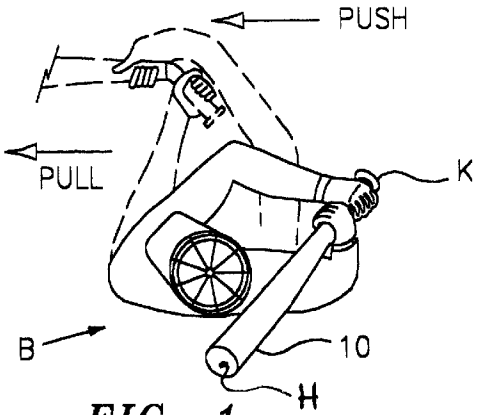
FIG. 1 top view of a batter gripping a training bat embodying the invention prior to swinging, in full line, and showing in broken line the articulation of the head and handle of the bat as the batter swings the bat.

When swinging at a baseball, the batter uses the lower hand on the bat as a moving pivot and additionally predominantly uses the lower hand to pull the bat forward in the swing. The upper hand is predominantly used to push the bat forward in the swing and accelerate the head of the bat. This is explained in conjunction with FIG. 1 where a batter's arms are shown in full line in a position prior to the swing and in broken line after impact with the ball or near the completion of a swing.

When swinging a training bat 10 embodying the invention, the bottom hand begins the swing by pulling the knob end K of training bat 10 toward the front side of the body (left side as shown for a right handed hitter) as indicated by the arrow PULL. As the bottom hand moves toward the front side of the body, the upper hand pushes the bat head H through the ball as indicated by the arrow PUSH. Many younger batters and inexperienced players fail to use their upper hand properly and as a result do not accelerate the bat through a swing. In a training bat embodying the invention a batter cannot properly accelerate the bat through a swing without using his upper hand properly. With a training bat embodying the invention, a batter experiences a mechanical couple action of opposing forces of the bottom and top hands rotating together. A training bat embodying the invention also helps a batter develop a compact inside swing with the bat head up and accelerating it through contact with the ball and adding length of swing to the follow through.

Due to a lack of strength, many batters begin their swing by opening the front of the body too soon and develop a bottom hand oriented swing. A training bat embodying the invention forces a batter to properly use the upper hand and ann or they will not be able to hit during tee or soft toss drills. A training bat embodying the invention is utilized to impart understanding of the function of the front elbow in the swing and how it creates the proper leverage about a fulcrum upon which the rotation force generated by the swing is amplified. The rotational force is in direct proportion to the distance between the fulcrum, front elbow and the applied force delivered by the top hand. If a hitter slides the front elbow forward or lifts it during the swing, the leverage changes and the hitter loses power. A training bat embodying the invention also teaches a batter not to swing the top hand too early which would cause the bat to sweep or cast during a swing. When a batter sweeps or casts it prevents proper extension of the arms through contact with the ball and proper follow-through.

As previously mentioned a training bat where the batter grasps the handle on either side of a point of articulation or pivot on the handle is disclosed in U.S. Pat. No. 4,399,996. The present invention provides training bats of this general type of new and improved construction and methods of making the same.

Figure 2:
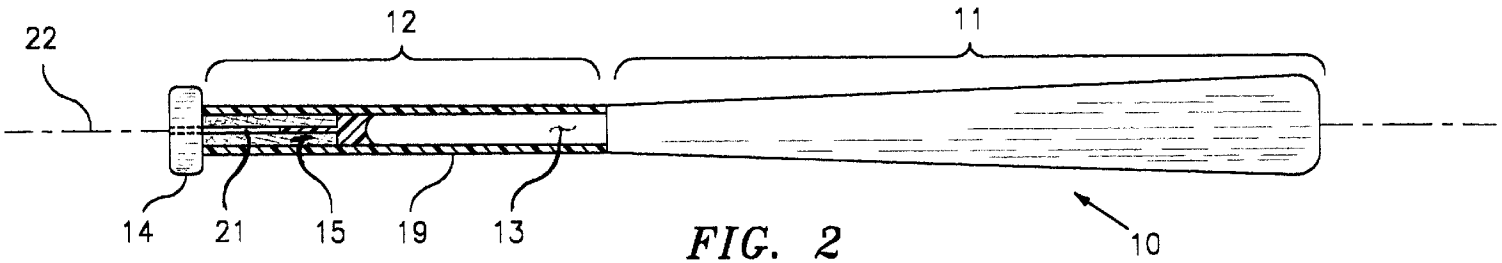
FIG. 2 is a side elevation of a baseball training bat embodying the invention, partially in half section.
Figure 3:
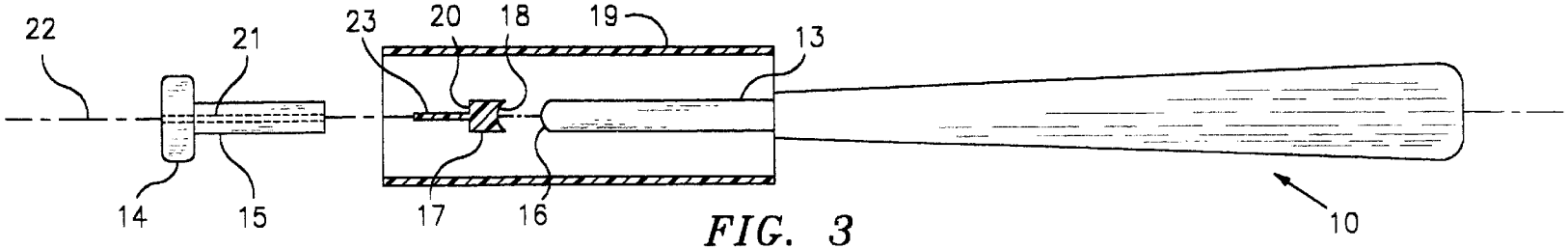
FIG. 3 is side elevation of the training bat of FIG. 2 showing elements thereof longitudinally separated and a sleeve about the gripping portion in expanded cross section.

Reference is now made to FIG. 2 which shows a first fully assembled training bat constructed in accordance with the invention in conjunction with FIG. 3 which shows the bat in a longitudinally exploded view. In FIG. 3 a sleeve 19 is shown in greatly expanded size in half section for clarity of illustration.

A training bat 10 comprises a head portion 11 and a gripping portion 12. Part 13 of the gripping portion 12 is defined on and extends from head 11. The other part of gripping portion 12 includes a knob 14 with an extending shaft 15. The training bat 10 may initially be formed on a lathe in a conventional manner, then the two gripping portions are turned down, about two-tenths inch (0.20") in diameter, for a particular size bat. The gripping portion 12 is then cut to form the two gripping portions 13 and 15. The free end of gripping portion 13 is rounded as shown by the reference numeral 16. A bearing member 17 having a concave surface 18 is provided. An elastomeric sleeve 19, essentially the length of gripping portion 12 having an inside diameter slightly less than the diameter of the turned down gripping portion 12 is placed over gripping portion 13 with surface 18 of bearing member 17 in contact with rounded end 16. Alternately, the bearing member may be inserted in sleeve 19 after the sleeve is positioned. Then the gripping portion 15 extending from knob 14 is inserted into sleeve 19 until in contact with side 20 of bearing member.

The sleeve 19 is in tight frictional engagement with both of gripping portions 13 and 15 and will maintain the gripping portions 13 and 15 together during and after thousands of swings of the bat. A sleeve 19 having an unstressed thickness of one eighth inch used with a turned down gripping portion as discussed above will result in the exterior of the sleeve being coincident with the exterior of the surface of head 11, with no indication of the decreased diameter of gripping portion 12.

Sleeve 19 in one form is an extruded elastomer. Sleeve 19 and sleeves on other training bats hereinafter described are formed from a material that provides rugged serviceability, a good grip, flexibility and some shock absorption. Additionally, the sleeve has good tear resistance and tensile strength. A preferred material is a thermoplastic vulcanite (TPV) formulated of synthetic rubber, ethylene-propolene terpolymer rubber (EPDM) fully cross linked with polypropolene (PP) which yields properties comparable to thermoset elastomers. The EPDM is selected for its flexibility, resistance to fatigue and soft touch characteristics. The PP improves the tear resistance and tensile strength. The EPDM/PP ratio will depend on the desired properties.

Sleeve 19 is shown as extruded, however, if a pre-molded bearing 17 is utilized it may be over molded or made in strip form and wrapped helically about the handle in the well known manner for a baseball bat.

The sleeve may be any material that includes the stated characteristics and permits the union of the two gripping portions 13 and 15 with a bearing member 17 there between and which acts to align the handle and head sections.

Any tendency for the parts to separate during a swing is resisted by the compression of the sleeve on the gripping portions reacting against attempted elongation of the sleeve. The sleeve will also prevent any pinching of fingers at the end of a swing when the sleeve acts to restore the handle and head toward axial alignment. In fact, as the sleeve recovers it will push any hand part out of the pivotal area.

At the present time it is preferred that the bearing member be formed in situ. To accomplish this construction, a passage 21 is drilled through knob 14 and gripping portion 15 along the axis 22 of the bat. Then the sleeve is placed on the gripping portions with the ends 16 slightly spaced. A silicon rubber is then injected into passage 21, to fill the space between rounded end 16 and the end of gripping portion 15, and allowed to cure. This technique will leave an extension or tail 23 of bearing member 17 extending back into passage 21, as exemplified in FIG. 3 . . .

The bearing 17 is of a material that will permit ease of pivotal movement of the rounded head 16 of the training bat and will absorb shock. A presently preferred material is silicone rubber. Other acceptable materials are butadiene rubber (SBR); EPDM; or nitrile rubber. The bearing may also be of nylon, ABS, polyurethane or polyvinyl chloride (PVC).

A bearing of these materials, either pre-molded or injected as described above has the desired characteristics to maintain spacing between the adjacent ends of the gripping portions 13 and 15, permit pivotal movement of the head portion and absorb shock during simulated swings. While presently preferred and acceptable materials for bearing 17 are stated above any material which provides the stated characteristics may be used.

The training bat of FIGS. 2 and 3 is of wood. An ultimate manufacturer of a training bat embodying the invention may have the bat manufacturer perform all of the wood cutting and boring of the wooden parts and deliver these parts to the ultimate manufacturer for assembly as described.

Figure 4:
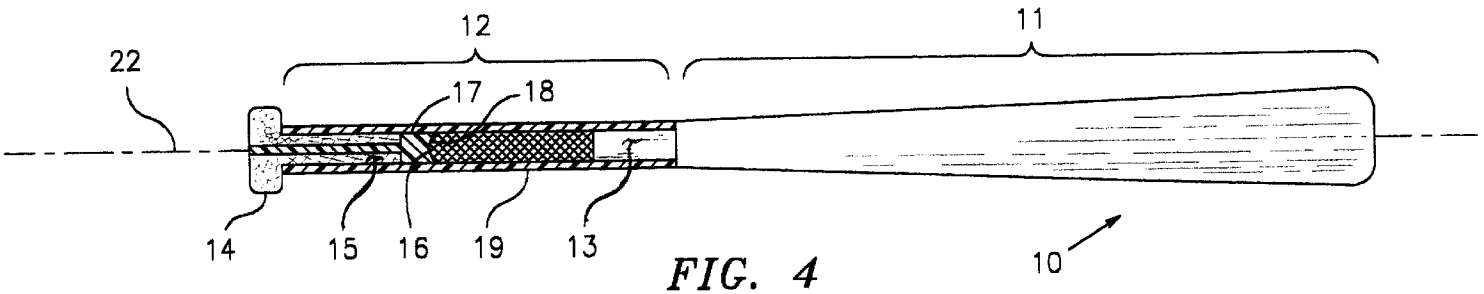
FIG. 4 is a side elevation, similar to FIG. 2 of another construction of a baseball bat training instrument embodying the invention, partially in half section.
Figure 5:
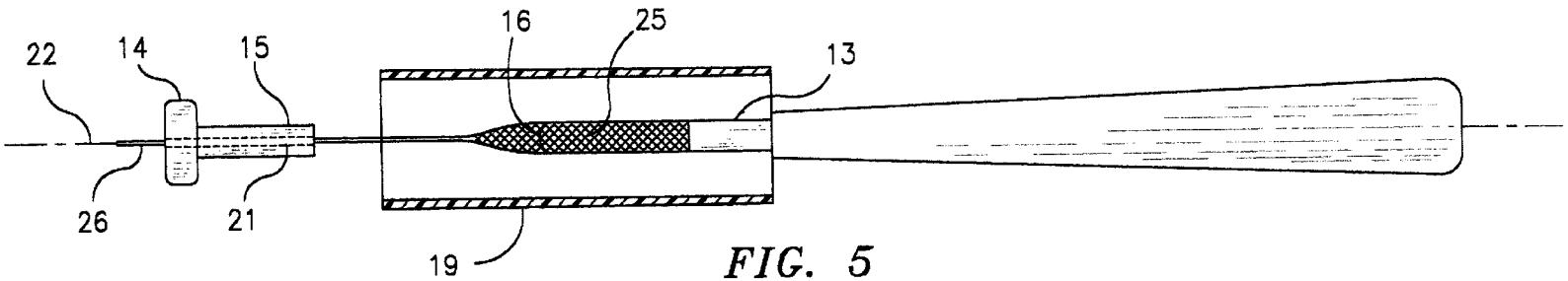
FIG. 5 is a longitudinally exploded view of the instrument of FIG. 4.
Figure 6:
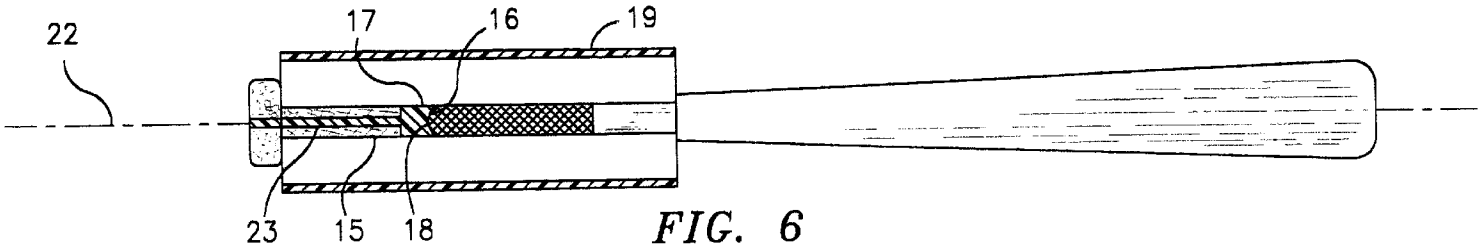
FIG. 6 is a view partially in half section of the training bat of FIG. 5 upon assembly.

Another embodiment of the invention is illustrated in FIGS. 4–6, where similar parts to the training bat of FIGS. 2 and 3 are identified by the same reference numerals as used in FIGS. 2 and 3. In this second embodiment, another element is added, a positive internal securing connection between gripping portions 13 and 15. A braided sleeve 25 commonly known as a Chinese sleeve and in the electrical art as a Kellums sleeve has a portion of its length fitted over gripping portion 13 and has a string or cord 26 attached to the free end thereof, see FIG. 5. Braided sleeve 25 then has a silicone rubber gel applied thereto at end 16 of gripping portion 13. Then sleeve 19 is pulled over gripping portion 13. String 26 is inserted through axial passage 21 in gripping portion 15 and gripping portion 15 is positioned in sleeve 19 a predetermined distance from end 16 of gripping portion 13 with the loose end of braided sleeve 25 pulled into axial passage 21 in gripping portion 15. Then the silicone rubber is injected into and through axial passage 21 to form bearing member 17, as shown in FIG. 6, with a tail 23 thereon in passage 21.

The silicon rubber will enter interstices of the wood and the braid and bond thereto and further provide a secure mechanical bond between gripping portions 13 and 15. This will be assurance that the head will not separate from the handle during a swing.

Figure 7:
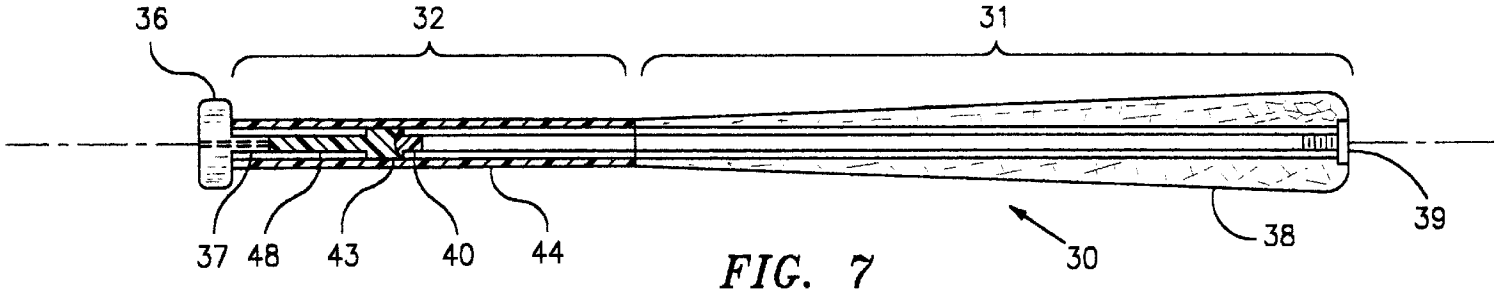
FIG. 7 is a side elevation, partially in half section, of another baseball training bat embodying the invention utilizing a construction which is applicable to other sports training instruments.
Figure 8:
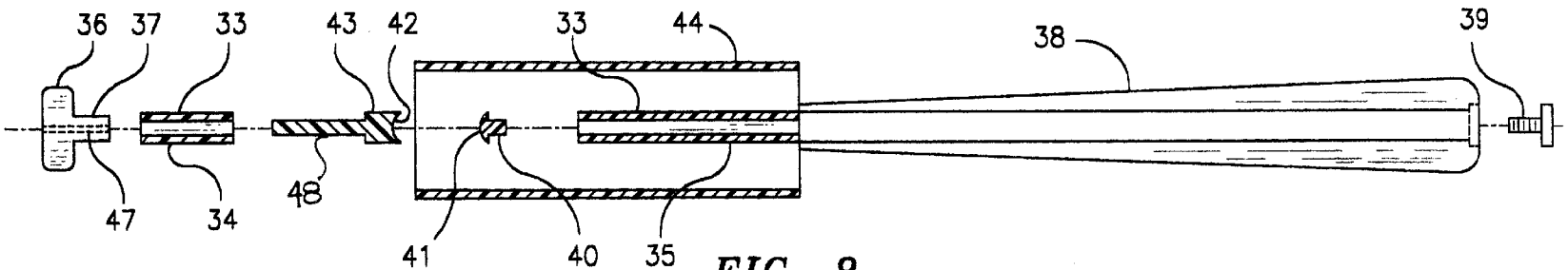
FIG. 8 is a longitudinally expanded view of the training bat of FIG. 7.

Another embodiment of the invention is shown in FIGS. 7 and 8. FIG. 7 shows a training bat, assembled, with the gripping portion in half section. FIG. 8 shows the training bat of FIG. 7 with parts thereof longitudinally separated. The bat 30 comprises a head portion 31 and a gripping portion 32. A rod 33 is cut into two gripping portions 34 and 35. The wooden head 38 of the training bat is bored axially to accept a length of rod 33 beyond gripping portion 35. Rod 33 is shown as hollow, however, it will be understood that rod 33 may be solid, or gripping portion 34 hollow to accept a knob 36 with a stem 37 extending therefrom. The wooden head 38 is axially bored to tightly receive rod 33 with gripping portion 35 extending therefrom. Rod 33 will be spaced slightly short of the end of wooden head 38 and a retainer, shown as a countersunk bolt 39, threaded into the bore. A plug 40 having a rounded outer surface 41 is inserted into the other end of rod 33 at the gripping portion 35. The rounded surface 41 of plug 40 will be in contact with the concave surface 42 of bearing 43, as shown in FIG. 7. Rod 33 may be of plastic such as high impact polyvinyl chloride or if tubular in form may be of a lightweight metal such as aluminum. The tubular form in plastic is preferable from a material cost standpoint.

In one method of assembly, the section of rod 33 including gripping portion 35 is fitted onto the axial bore in head 38, bolt 39 is threaded into the end of rod 33, plug 40 is inserted into the end of gripping portion 35, an elastomeric sleeve 44 is fitted over gripping portion 35 and then bearing 43 is inserted into the sleeve and into contact with surface 41 of plug 40. Then gripping portion 34 with the stub of knob 36 secured therein is positioned in sleeve 44 with gripping portion in contact with bearing 43. Stem 37 may be either a press fit into gripping portion 34 or mating threads may be defined on the two parts.

In the second and presently preferred method of assembly, bearing 43 is formed by injection of silicon rubber through axial passage 47 in knob 36 in the same manner as described in conjunction with FIGS. 2 and 3. The training bat 30 of FIG. 7 exemplifies this technique of construction with the tail 48 on bearing 43 in gripping portion 34.

By way of example only, the head 38 of bat 30, originally a standard softball bat, was axially bored to accept a one inch (1") diameter rod of high impact polyvinyl chloride (PVC) having a wall thickness of five-sixteenths inch. The construction of FIG. 7 without head 38 thereon is useful as a training instrument as hereinafter described.

The construction described in conjunction with FIGS. 7 and 8 lends itself to incorporation of the invention to training instruments for other sports where an instrument requires the use of two hands. Where the invention is embodied in other than a baseball/softball bat, such as a golf club, lacrosse stick, hockey stick or tennis racquet, not amenable to the use of a rod through the head of the instrument, the construction shown in FIG. 9 may be used. The instrument of FIG. 9 is exemplified as a baseball, but a head for an instrument of another sport as stated above may be placed on a suitably designed gripping portion of a training instrument for that sport.

Figure 9:
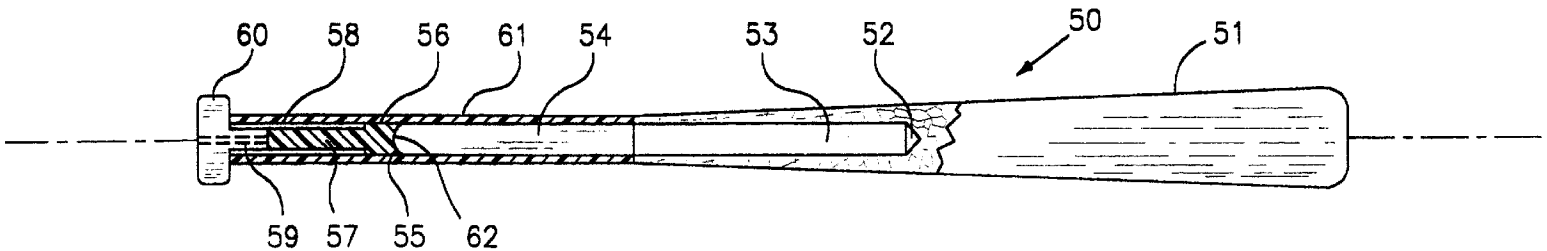
FIG. 9 is a side elevation, partly cut away and partly in half section of another sports training instrument embodying the invention.

FIG. 9 illustrates a training bat 50 which comprises a head 51 which is axially counter bored as indicated by the reference numeral 52. A rod 53 is received within counter bore 52 and extends outwardly therefrom as a gripping portion. Rod 53 is shown as being solid in FIG. 9, however it may be tubular as is rod 33 in FIGS. 7 and 8. The gripping portion 54 of rod 53 terminates in a rounded end 62 contacting the concave surface 55 of bearing member 56. As shown, bearing member 56 has been formed by the injection method, previously described. A tail 57 is integral with bearing member 56 and extends back into hollow gripping portion 58. The material of bearing member 56 is injected through axial passage 59 in knob and stem 60. An elastomeric sleeve 61 surrounds gripping portions 54, 58 and bearing 56.

The training bat of FIG. 9 exemplifies how the invention may be utilized in the handle portions of training instruments for other sports. The invention is useful in any sport in which a striking or throwing instrument is utilized which requires a coordinated push-pull motion of both hands to strike and accelerate an object or to throw an object as may be the case in lacrosse.

It has been determined that the structure of FIGS. 7 and 8 without the bat head 38 on rod 33 is useful in practicing hand-eye coordination as well as developing a proper bat swing. The device of FIGS. 7 and 8 without head 38 on rod 33 has been used to hit thrown golf balls and golf balls from an elevated tee similar to the tee used in T-ball. In such cases the rod 33 was the head of the bat.

Figure 10:
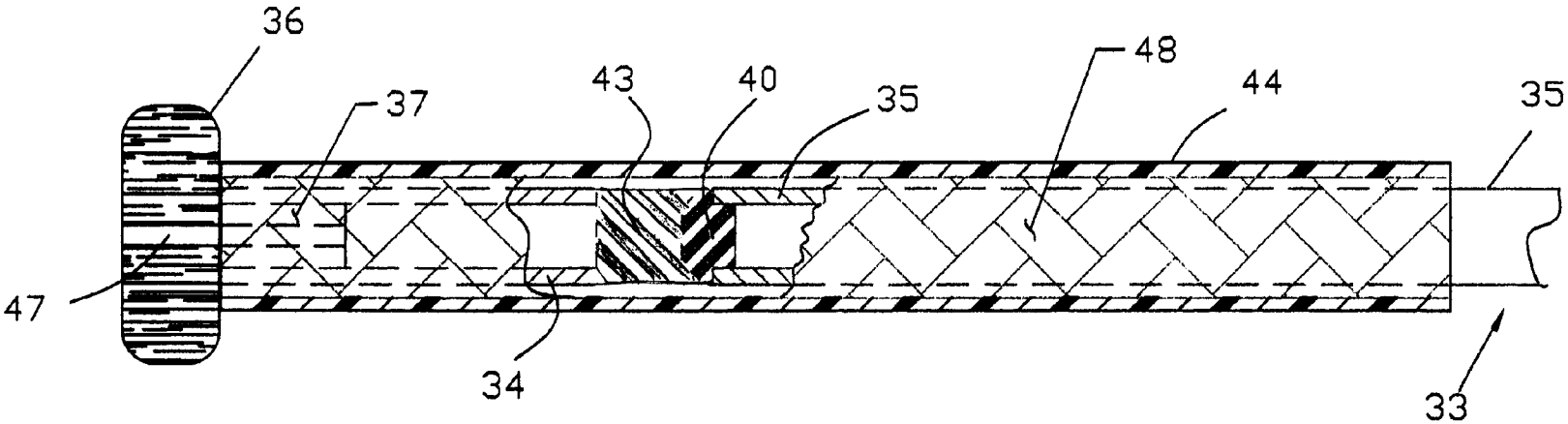
FIG. 10 is a longitudinal view, partially cut away and partially in half section of another sports training instrument embodying the invention

Such a construction together with another technique of connecting the gripping portions is shown in FIG. 10. The training instrument shown in FIG. 10 is of the same basic arrangement as the training instrument of FIGS. 7 and 8, and the same reference numerals are used in FIG. 10 to identify similar parts.

In FIG. 10 a braided sleeve 48 is positioned on the outside of both sections 34 and 35 of rod 33 and tensioned thereon. The braided sleeve is broken away in the area of plug 40 and bearing 43 and elastomeric sleeve 44 is shown in half section. This instrument may use a pre-molded bearing or have the bearing formed in situ by injecting the material Through axial passage 47 in knob 36 and stem 37. In assembly the braided sleeve is pulled over the gripping portion of rod after plug 40 is inserted in rod 33 to provide the rounded end. If a pre-molded bearing is used, it is inserted into braided sleeve until in contact with plug b40 as shown. The sleeve 48 is then tensioned so that it will tightly grasp parts 34 and 35 of rod 33. Elastomeric sleeve 44 is then applied over braided sleeve 48 and any excess of braided sleeve 48 is trimmed off past gripping portion 34. Stem 37 of knob 36 is then attached to gripping portion 34 as previously described.

If bearing 43 is to be formed in situ, the adjacent ends of gripping portions 34 and 35 are spaced a predetermined distance, stem 37 is fitted to gripping portion 34 and silicone rubber is injected through axial passage 47. This construction provides a mechanical connection between the two hand gripping portions of the instrument The safety feature of FIGS. 4–6 (the braided sleeve) or the braided sleeve of FIG. 10 is preferably utilized in all embodiments of the invention to mechanically tie the gripping portions together. This feature is incorporated in all embodiments by reference. This feature is used primarily as a safety feature from the stand point of a claim of product liability resulting from misuse of a training instrument. It is believed that the elastomeric sleeves covering the gripping portions in all embodiments will prevent any separation of the head from the handle so long as a hand grips the gripping portion of the head.

While training bats embodying the invention have been disclosed primarily as being of wood, the training bats may be a composite of materials as disclosed in FIGS. 7–8, 9 and 10. A training bat as disclosed in FIGS. 2 and 3 maybe molded of high impact polyvinyl chloride or other plastic.

It may thus be seen that the objects of the invention set forth above as well as those made apparent are efficiently attained. While various preferred embodiments of the invention have been set forth for purposes of disclosure, modifications to the disclosed embodiments as well as other embodiments of the invention may occur to those skilled in the art. Accordingly, the appended claims are intended to cover all modifications to the disclosed embodiments of the invention as well as other embodiments thereof which do not depart from the spirit and scope of the invention.

What is claimed is:

1. A training instrument for a sport in which an object is struck or thrown by a player grasping the instrument with two hands, said instrument comprising a handle having a first hand gripping portion and a separate head or rod having a second hand gripping portion, a bearing member and an elastomeric sleeve, said handle and said head normally having a common longitudinal axis, a free end of said gripping portion of said head or rod being at least partially rounded and being in contact with said bearing member, said bearing member being in contact with said handle and having a concave surface receiving said at least partially rounded end, said sleeve extending over said first gripping portion of said handle, said bearing and said second gripping portion of said head.

2. The instrument of claim 1 said training bat comprising a wooden bat including a knob at one end thereof, wherein said gripping portions have been formed by turning down a length of said bat a predetermined distance from said knob and the bat cut in said turned down length to define said first gripping portion of said handle and said second gripping portion of said head.

3. The instrument of claim 2 wherein the thickness of said sleeve, when positioned on said gripping portions is essentially the same as the dimension of said bat before it was turned down.

4. The training instrument of claim 1 wherein said handle has an axial passage defined there through, said sleeve is positioned on said gripping portion of said handle and said gripping portion of said handle with a predetermined space between said gripping portions, and said bearing is formed between said gripping portions by injection through an axial passage in said handle with a bearing material that permits ease of pivotal movement and absorbs shock, such as but not limited to silicone rubber.

5. The training instrument of claim 2 further including a braided sleeve of predetermined length, said braided sleeve having a diameter to fit about said hand gripping portion of said head or rod and frictionally engage thereon when tensioned, said braided sleeve extending through an axial passage in said handle, with said bearing material that permits ease of pivotal movement and absorbs shock, such as but not limited to silicone rubber impregnating the braid of said braided sleeve.

6. The training instrument of claim 1 further including a braided sleeve fitted over said first hand gripping portion and said second hand gripping portion positioned on a rod-like member and tensioned thereon to frictionally engage said hand gripping portions on either side of said bearing.

7. The training instrument of claim 5 wherein said handle and said head are made of wood and said bearing material impregnates said braided sleeve and enters the interstices of the wood it contacts.

8. A training instrument for a sport in which an object is struck or thrown by a player grasping the instrument with two hands comprising a head and a handle separated by a bearing member which aids pivotal movement of said head with respect to said handle, said handle having a first hand gripping portion, said head having a rod-like member extending axially therefrom toward said handle, said rod-like member providing a second hand gripping portion and being at least partially rounded at the end adjacent said handle, said bearing member having a concave surface in contact with said at least partly rounded end and in contact with said handle, a sleeve extending about said gripping portions and said bearing.

9. The instrument of claim 8 which is a training bat, said training bat comprising a wooden bat including a knob at one end thereof, wherein said gripping portions have been formed by turning down a length of said bat a predetermined distance from said knob and the bat cut in said turned down length to define said handle and said head gripping portions.

10. The instrument of claim 9 wherein the thickness of said sleeve, when positioned on said gripping portions is essentially the same as the dimension of said bat, before it was turned down.

11. The training instrument of claim 8 wherein said handle has an axial passage defined there through, said sleeve is positioned on said first handle gripping portion and said rod-like member providing for the second handle gripping portion with a predetermined space between said gripping portions, and said bearing is formed between said gripping portions by injection through an axial passage in said first handle with a bearing material that permits ease of pivotal movement and absorbs shock, such as but not limited to silicone rubber.

12. The training instrument of claim 11 further including a braided sleeve of predetermined length, said braided sleeve having a diameter to fit about said hand gripping portion of said rod-like member and frictionally engage thereon when tensioned, said braided sleeve extending into said axial passage into said handle, said bearing material impregnating the braid of said braided sleeve.

13. The training instrument of claim 12 wherein said handle and said head are made of wood and said bearing material impregnates said braided sleeve and enters the interstices of the wood it contacts.

14. A training instrument for a sport in which an object is struck or thrown by a player grasping the instrument with two hands comprising a rod and a handle separated by a bearing member which aids pivotal movement of said rod with respect to said handle, said handle having a first hand gripping portion, said rod providing a second hand gripping portion of the same cross section as said first and gripping portion of said handle and being at least partially rounded at the end adjacent said handle, said bearing member having a concave surface in contact with said at least partly rounded end and in contact with said handle, a sleeve extending about said gripping portions and said bearing.

15. The training instrument of claim 14 further including a head member received on said rod.

16. The training instrument of claim 15 wherein said head member is a bat.

17. The training instrument of claim 14 wherein said handle has an axial passage defined there through, said sleeve is positioned on said handle gripping portion and said rod-like member providing for the second handle gripping portion with a predetermined space between said gripping portions, and said bearing is formed between said gripping portions by injection through an axial passage in a first hand gripping handle with a bearing material that permits ease of pivotal movement and absorbs shock, such as but not limited to silicone rubber.

18. The training instrument of claim 17 further including a braided sleeve of predetermined length, said sleeve having a diameter to fit about said hand gripping portion of said rod and frictionally engage thereon when tensioned, said braided sleeve extending into an axial passage in said handle, said bearing material impregnating the braid of said braided sleeve.

19. The training instrument of claim 18 wherein said handle and said head are of wood and said bearing material impregnates said braided sleeve and enters the interstices of the wood it contacts.

20. The training instrument of claim 17 further including braided sleeve fitted over said first hand gripping portion and said rod-like member providing for the second hand gripping portion and tensioned thereon to frictionally engage said hand gripping portions on either side of said bearing.

* * * * *